United States Patent [19]

Kopse

[11] 4,216,912

[45] Aug. 12, 1980

[54] FUEL INJECTION NOZZLE

[75] Inventor: Odon Kopse, Stuttgart, Fed. Rep. of Germany

[73] Assignee: Robert Bosch GmbH, Stuttgart, Fed. Rep. of Germany

[21] Appl. No.: 906,290

[22] Filed: May 15, 1978

[30] Foreign Application Priority Data

Jun. 10, 1977 [DE] Fed. Rep. of Germany ..... 2726296

[51] Int. Cl.[2] ..... F02M 61/04

[52] U.S. Cl. ..... 239/533.4; 239/563

[58] Field of Search ..... 239/66, 533.3–533.12, 239/584, 562, 563; 123/32 R, 32 JV

[56] References Cited

U.S. PATENT DOCUMENTS

| | | | |
|---|---|---|---|
| 1,834,061 | 12/1931 | Joachim | 239/533.4 X |
| 2,003,814 | 6/1935 | Taylor | 239/533.7 |
| 3,612,407 | 10/1971 | Itano | 239/533.4 |
| 4,096,999 | 6/1978 | Eckert et al. | 239/533.5 |

FOREIGN PATENT DOCUMENTS

| | | | |
|---|---|---|---|
| 2301679 | 7/1974 | Fed. Rep. of Germany | 123/32 JV |
| 42-13889 | 3/1967 | Japan | 123/32 JV |

*Primary Examiner*—Andres Kashnikow
*Attorney, Agent, or Firm*—Edwin E. Greigg

[57] ABSTRACT

The invention concerns a fuel injection nozzle with a valve needle and a hollow needle, both of which are loaded by only one spring. During opening one of the needles strikes a stop while the other needle continues to move against the force of the spring.

6 Claims, 1 Drawing Figure

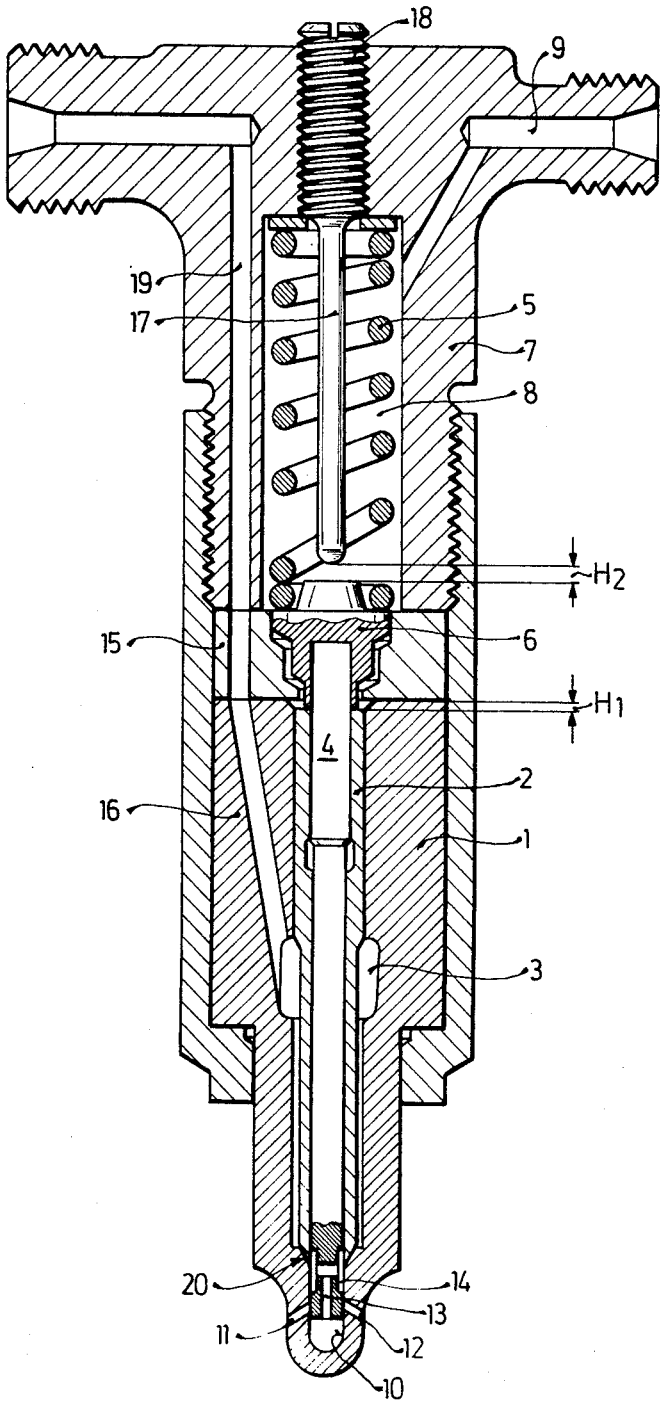
18
9
19
17
5
7
8
H2
15
6
H1
4
2
16
1
3
20
14
13
11
12
10

FUEL INJECTION NOZZLE

BACKGROUND OF THE INVENTION

The invention relates to a fuel injection nozzle for internal combustion engines having telescoping valve needles, the first of which can be moved against a spring force by the fuel supplied into the pressure chamber, thereby controlling the flow of the fuel, and a second hollow needle which substantially encompasses the first of said valve needles. In known fuel injection nozzles of this type the valve needle and the hollow needle are each loaded by generally separate closing springs in order to obtain a pressure stage during the injection, in other words, in order to attain a different angle of injection, i.e., fuel spreading during idling and full load, or to attain a type of preliminary and main injection. First of all two separate springs are relatively expensive, and secondly each spring requires the necessity of having its own independent adjustment means including the requirement for separate supports for the springs and the structural space therefor.

OBJECT AND SUMMARY OF THE INVENTION

The fuel injection nozzle according to this invention has the distinct advantages of being considerably less expensive to manufacture than known nozzles, is smaller in size and can be produced by work people who have less skill.

Another advantage of this invention is that the nozzle body and the second or hollow needle together form a chamber of limited area into which fuel when introduced causes the second needle to move from a closure position so that fuel can be supplied into a bore provided in the first needle and be discharged into the cylinder of the internal combustion engine.

The invention is not limited to a slide nozzle having inwardly opening needles such as shown and described herein, but rather also concerns combined inwardly and outwardly opening needles, which, for example, might also cooperate with a type of nozzle that has a spindle in an injection opening.

The invention will be better understood as well as further objects and advantages thereof become more apparent from the ensuing detailed description of a preferred embodiment taken from the drawing.

BRIEF DESCRIPTION OF THE DRAWING

The single FIGURE in the drawing shows a longitudinal cross-sectional view of the nozzle of this application.

DESCRIPTION OF THE PREFERRED EMBODIMENT

A hollow valve needle 2 is guided in a nozzle body 1 in such a manner that it is radially sealed over part of its length, and together with the nozzle body 1 defines a second pressure chamber 3. A valve needle 4, which is in the form of a slide needle, is arranged in the hollow needle 2 so that it is also radially sealed as well as axially slidable. The hollow needle 2 and the valve needle 4 are loaded by a single closing spring 5, which acts simultaneously on both needles through the medium of a spring supporting plate 6. The chamber 8, which encloses the spring 5 in a nozzle holder 7, is connected with a return line (not shown) by means of a return channel 9. The valve needle 4 has a lower terminal portion that projects into a blind bore 10 in the nozzle body 1 defining a first pressure chamber. During its stroke movement this valve needle 4 successively opens injection apertures 11 and 12. A channel 13 is arranged in the valve needle 4 and opens into an annular groove 14 in the outer surface of the valve needle 4, said groove being partially covered by the end of the hollow needle 2, all of which is clear from a study of the drawing. An apertured intermediate plate 15 that is interposed between the nozzle holder 7 and the nozzle body 1 serves as a stop for the hollow needle 2. The length of the entire stroke of the valve needle 4 together with the plate 6 is determined by a stop 17 which projects into the spring chamber 8, said stop 17 being adjustable from outside the nozzle by means of an integrated screw means 18.

The fuel travels from a fuel injection pump (not shown), through a pressure duct of the fuel injection nozzle, through a channel 19, which leads through the apertured nozzle holder 7, the intermediate plate 15, the nozzle body 1, and then passes into the pressure chamber 3 of the hollow needle 2. When the pressure is sufficient the hollow needle 2 is lifted away from its seat 20 against the force of the spring 5, thereby connecting the pressure chamber 3 and the channel 13 with the blind bore 10 beneath the nozzle needle 4. Thus in this manner the connection between the pressure chamber 3 and the blind bore 10 are accomplished by means of the annular groove 14.

After the hollow needle 2 is opened, the fuel pressure acts not only on the shoulders of the hollow needle 2 but also acts in the direction of opening on the frontal surface of the valve needle 4. After completion of a certain stroke, the valve needle 4 opens the first injection opening 11, so that a measured pre-injection of fuel can take place. Instead of merely one injection opening being provided, of course a number of ports could be arranged in the same plane and spaced around the nozzle body. As soon as the nozzle needle 4 and the hollow needle 2 have completed the stroke $H_1$, the hollow needle 2 strikes the intermediate plate 15, which results in a delay of the opening movement. Not until a greater pressure is attained, which is necessary because of the smaller surface, is the valve needle 4 pushed farther up into the hollow needle 2 and against the closing spring 5 until it reaches the stop 17. Within this stroke $H_2$ the second injection opening 12 or the second level of injection openings is thereby revealed by the valve needle 4. After completion of the fuel delivery by the fuel pump, because of the surface ratio, the valve needle 4 first closes the injection openings 11 and 12. Thereafter the hollow needle is pushed back against its seat 20.

The invention, namely the activation of two valve needles for a pressure stage or pre-injection using only one spring, is, of course, not limited to the embodiment of the invention shown. It would also be conceivable for both needles to be acted upon from the very beginning by a common pressure source and to use, instead of a slide needle, a pin needle arranged in a central injection opening or a known inwardly-opening valve needle. It would also be conceivable for the inner needle to be the first to strike a stop, and for the hollow needle to continue the stroke against the force of the spring.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines including a first pressure chamber in the nozzle, a valve needle which can be moved against a spring force by the fuel supplied into said first pressure chamber for controlling the flow of fuel from said nozzle, a hollow needle containing said valve needle for controlling the flow of fuel into said first pressure chamber, both of said needles movable through a stroke $H_1$ and one of said needles movable through a stroke $H_2$, further wherein a spring supporting plate is interposed between a spring means and said valve and hollow needles and said spring means urges both needles into a closing direction and subsequent thereto both said needles move through said stroke $H_1$ whereupon one of said needles strikes a stop plate and the other of said needles continues to move against the force of said spring means until the remainder of said stroke $H_2$ is effected.

2. A fuel injection nozzle as claimed in claim 1, further wherein a second pressure chamber is provided between a nozzle body and a peripheral portion of said hollow needle and fuel introduced to said second pressure chamber moves said hollow needle so that fuel can be supplied into a bore in proximity to said valve needle defining said first pressure chamber.

3. A fuel injection nozzle as claimed in claim 1, further wherein said valve needle comprises a rod, the terminal end of which projects into a blind bore that forms said first pressure chamber.

4. A fuel injection nozzle as claimed in claim 2, further wherein said valve needle controls plural injection openings which are arranged in the nozzle body, in dependence on the stroke of said valve needle.

5. A fuel injection nozzle as claimed in claim 3, further wherein said valve needle opens at least a first injection opening during the first stroke $H_1$ and at least one second injection opening at the latest subsequent to the hollow needle engaging said stop plate.

6. A fuel injection nozzle as claimed in claim 1, wherein said valve needle includes communicating passages and fuel flow therethrough is controlled by said hollow needle.

* * * * *